US007967299B2

(12) United States Patent
McClanahan

(10) Patent No.: US 7,967,299 B2
(45) Date of Patent: Jun. 28, 2011

(54) BODY TO BONNET SEAL ON A BLOWOUT PREVENTER

(75) Inventor: Perry Lee McClanahan, Montgomery, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 12/504,183

(22) Filed: Jul. 16, 2009

(65) Prior Publication Data

US 2011/0012311 A1 Jan. 20, 2011

(51) Int. Cl.
*F16L 17/06* (2006.01)
*F16J 15/02* (2006.01)

(52) U.S. Cl. ..... 277/608; 277/630; 277/643

(58) Field of Classification Search ..... 277/327, 277/324, 608–609, 616, 630, 643
See application file for complete search history.

(56) References Cited

U.S. PATENT DOCUMENTS 2,178,698 A * 11/1939 Penick et al. ..... 166/86.1
3,001,803 A * 9/1961 Hill et al. ..... 285/123.2
3,028,917 A * 4/1962 Rhodes ..... 166/97.5
4,655,284 A * 4/1987 McIlvride ..... 166/84.1
6,510,895 B1 * 1/2003 Koleilat et al. ..... 166/208
7,125,055 B2 * 10/2006 Dallas ..... 285/354
7,216,872 B1 * 5/2007 Shaw et al. ..... 277/510
2005/0051362 A1 * 3/2005 McGuire et al. ..... 175/57
2005/0082829 A1 * 4/2005 Dallas ..... 285/354
2005/0242519 A1 * 11/2005 Koleilat et al. ..... 277/434
2007/0051164 A1 * 3/2007 Van Winkle ..... 73/37
2007/0089887 A1 * 4/2007 Gomez ..... 166/386
2007/0102150 A1 * 5/2007 McGuire et al. ..... 166/75.13
2008/0142210 A1 * 6/2008 McGuire et al. ..... 166/85.3

* cited by examiner

*Primary Examiner* — Vishal Patel

(74) *Attorney, Agent, or Firm* — JL Salazar Law Firm

(57) ABSTRACT

A seal comprises a metal seal ring with a first slanted mating surface for sealing engagement with a mating surface on a body and a second slanted mating surface for sealing engagement with a mating surface on a bonnet. The mating surfaces are the same angle as measured from the axis of the ram of the BOP. The seal also defines opposing slanting surfaces which provide a degree of flexure to the seal for sealing engagement. With the application of pressure on the inside surfaces of the seal, the mating surfaces are pressed even harder against the mating surfaces of the body and bonnet.

4 Claims, 2 Drawing Sheets

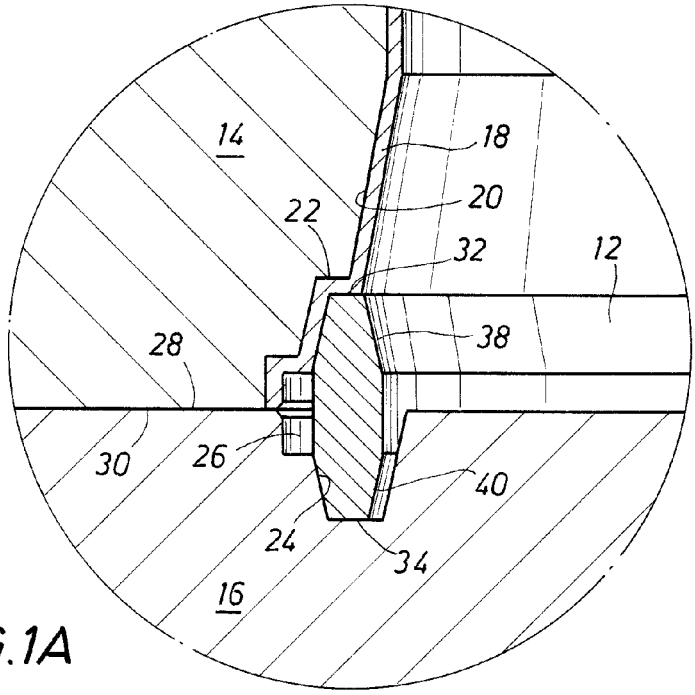
FIG.1A
FIG.2B
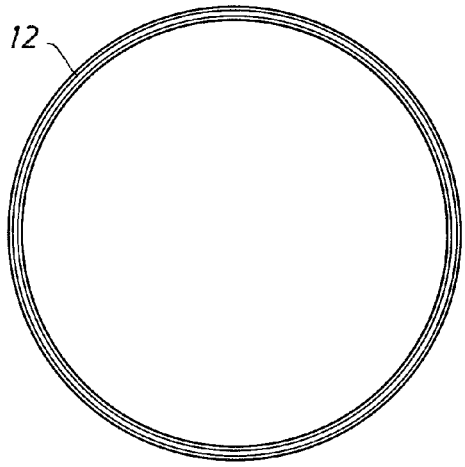
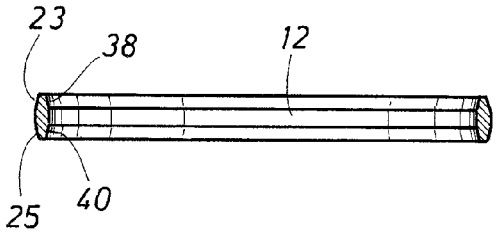
FIG.2A

BODY TO BONNET SEAL ON A BLOWOUT PREVENTER

FIELD OF THE INVENTION

The present invention relates generally to the field of blowout preventers, and, more particularly, to a seal between the body and the bonnet of a blowout preventer or other pressure vessel.

BACKGROUND OF THE INVENTION

The use of blowout preventers (BOPs) in oil and gas fields is well known. A blowout preventer generally includes a housing with a bore extending through the housing. Opposed chambers extend laterally from the bore in the housing and communicate with the bore. Rams are positioned in the opposed chambers and the rams are connected to rods that are supported for moving the rams inwardly into the bore to close off the bore, thereby defining a zone above the rams and a zone below the rams. The force for moving the rams into the bore is commonly provided by respective hydraulically operated pistons coupled to the rods, with each piston enclosed within its respective operating cylinder. The rods also serve to retract outwardly from the bore to open the bore. In many BOPs, tail rods extend from the pistons outwardly of the operating cylinder of the pistons.

Various types of rams may be employed such as those which engage circumferentially around a tubular member extending through the BOP, such as for example coiled tubing, drill pipe, production pipe, or the like. The term "tubing" used herein refers to any of these types of tubular member. The BOP ram may provide for sealing engagement with the tubular member, while other types of BOP are provided with cutting surfaces for shearing the tubular member which extends through the bore of the blowout preventer.

Among other uses, BOPs are commonly used in oil and gas exploration and production systems as a means of holding the tubular member and isolating the well bore pressure during a variety of conditions, including emergencies. The configuration of the BOP rams and side port facility allow well-control operations to be conducted under a variety of conditions.

For example, blowout preventers are commonly used to seal a wellbore. In drilling operations, the pressure in the wellbore is adjusted to at least balance formation pressure by increasing drilling mud density in the wellbore or increasing pump pressure at the surface of the well. At times, a drill bit may penetrate a down hole layer having a pressure higher than the pressure maintained in the wellbore. In this event, it may be necessary to deploy the blowout preventer to prevent damage to equipment or harm to personnel above the well bore.

When the blowout preventer is deployed, one region of the blowout preventer that presents a possible point of leakage is the joint between the blowout preventer body and the bonnet. Commonly, an elastomeric O-ring seal is positioned in a depression between the body and the bonnet and crushed as the bonnet is bolted to the body. The friction force between the O-ring seal and the mating surfaces on the body and bonnet provide the seal against fluid leakage under pressure.

This type of seal works well for sealing normally encountered pressure at a well head. Unfortunately, for higher pressure applications, this type of seal has been known to leak. Also, care must be exercised in aligning the seal so that an even force is applied around the entire perimeter of the seal. Otherwise, a weak spot will be installed with the installation of the seal.

Thus, there remains a need for a body to bonnet seal that is capable of withstanding higher pressures. Such a sealing device should be self aligning and should be impervious to the harsh environment in which the seal finds application, such as for example down hole. The seal described herein solves these and other problems in the art.

SUMMARY OF THE INVENTION

The seal described herein comprises a metal seal ring with a first slanted mating surface for sealing engagement with a mating surface on a body and a second slanted mating surface for sealing engagement with a mating surface on a bonnet. The mating surfaces are the same angle as measured from the axis of the ram of the BOP. The seal also defines opposing slanting surfaces which provide a degree of flexure to the seal for sealing engagement. With the application of pressure on the inside surfaces of the seal, the mating surfaces are pressed even harder against the mating surfaces of the body and bonnet.

As described in this specification, the seal has a particular application for sealing between the bonnet and the body of a blowout preventer. However, the seal may find application in other high pressure structures calling for sealing a joint between opposing bodies. These and other features and advantages of this seal will be apparent to those of skill in the art from a review of the following detailed description.

A seal in an axially oriented pressure vessel is provided. The seal has a body defining a slanted surface angled relative to the axis greater than 0° and less than 45° , a bonnet defining a slanted surface angled relative to the axis greater than 0° and less than 45° , a seal ring defining a first slanting surface for mating engagement with the slanted surface of the body and a second slanting surface for mating engagement with slanted surface of the bonnet, and a void between the body, the bonnet, and the seal ring. The pressure vessel is a blowout preventer. The seal is metal. The seal may further comprise a third slanted surface of the seal ring opposite the first slanted surface and a fourth slanted surface on the seal ring opposite the second slanted surface. The seal may also further comprise a liner between the body and the seal ring.

BRIEF DESCRIPTION OF THE DRAWINGS

FIG. 1A is a detail section view of a seal interface with the seal described.

FIG. 2A is a side view of a seal.

FIG. 2B is plan view of a seal.

DETAILED DESCRIPTION OF A PREFERRED EMBODIMENT

Figure 1:
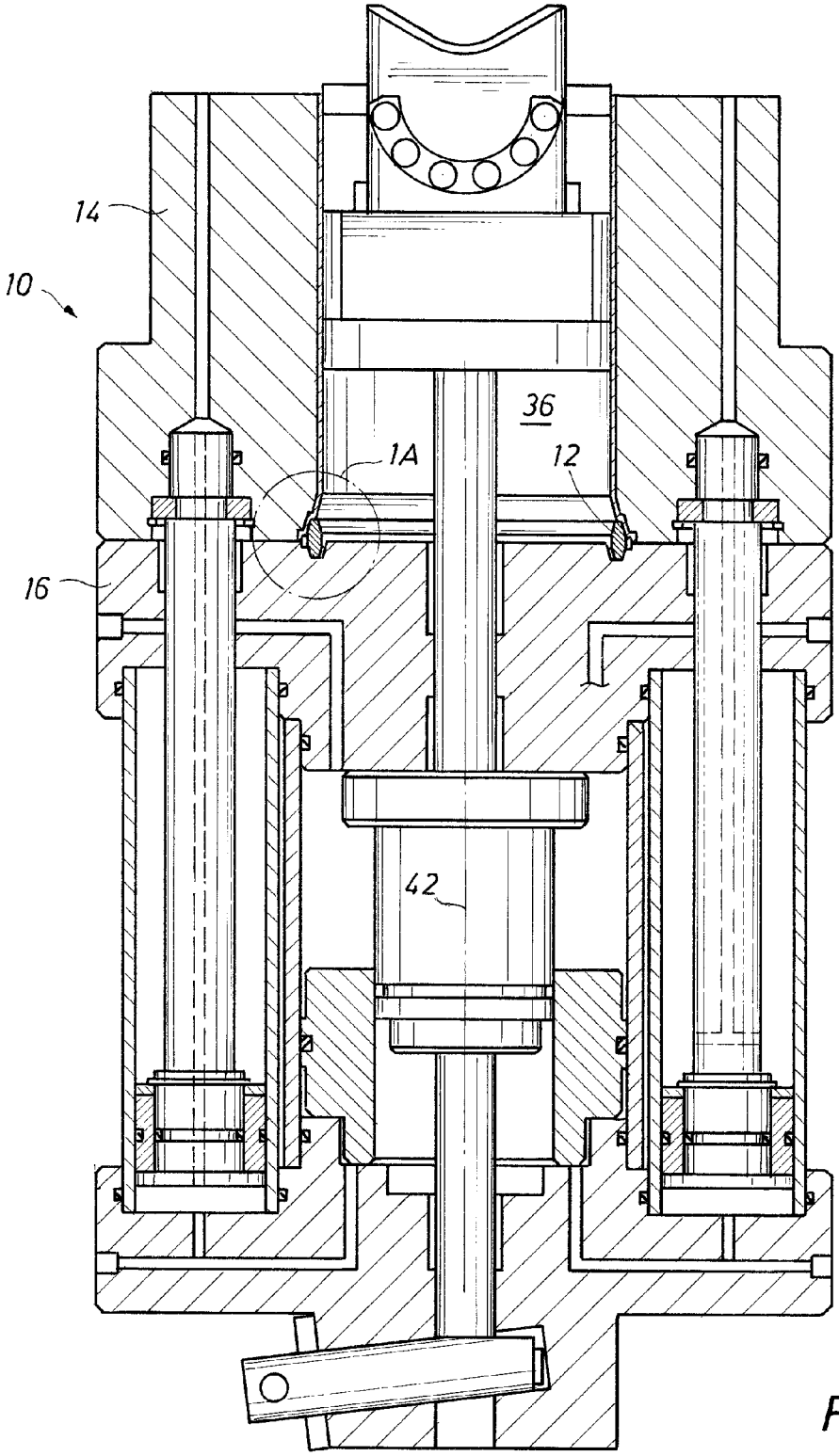
FIG. 1 is a top section view of a BOP ram with a seal installed.

FIG. 1 illustrates a ram 10 of a blowout preventer. It is to be understood that there is another ram opposing ram 10, but it not shown in FIG. 1. A seal 12 is positioned between a ram body 14 and a bonnet 16 (see also FIG. 2B). As shown in FIG. 2B, the seal 12 preferably forms a ring, and may be referred to herein as a seal ring. The seal ring is preferably made of a corrosion resistant metal, such a stainless steel, Inconel®, a registered trademark of International Nickle Company, or other metal. FIG. 1 illustrates the entire ram structure, but only the seal 12, body 14, and bonnet 16 are shown in hatch format to focus on the structure and function of the seal.

The seal 12 is identified in FIG. 1 with a detail, labeled A. The seal and surrounding structure are shown in greater detail in FIG. 1A. A liner 18 covers a surface 20 of the ram body 14. The surface 20 includes a body surface seat 22 and the bonnet defines a bonnet surface seat 24. The surface seats 22 and 24 are configured for sealing engagement with the seal 12. A void 26 is provided between the liner 18, the bonnet 16, and the seal permitting a surface 28 of the body 14 and a surface 30 of the bonnet 16 to firmly abut each other when the body and bonnet are drawn together.

As the body and bonnet are drawn together, with the seal 12 positioned between them, the seal is captured by the surface 22 against a slanted seal surface 23 and the surface 24 against a slanted seal surface 25 (see FIG. 2A). A shelf 32 on the liner 18 and a recess 34 in the bonnet rigidly retain the seal. As fluid under pressure fills a ram cylinder 36 of the ram (see FIG. 1), the pressure of the fluid tends to seat the seal even more firmly against the surface seats 22 and 24. Also, as the body and bonnet are drawn together, the seal tends to flex radially inwardly. This action is aided by the feature of a slanted surface 38 and a slanted surface 40. With the slanted surfaces that define the cross-section of the seal, the seal tapers upwardly and downwardly, allowing the flexure.

Note that the surfaces 23, 25, 38, and 40 each make an angle in relation to an axis of the ram of about 15° to 20°, but certainly less than 45°.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A seal in an axially oriented pressure vessel comprising:

a body defining a slanted surface angled relative to the axis greater than 0° and less than 45°;

a bonnet defining a slanted surface angled relative to the axis greater than 0° and less than 45°;

a seal ring defining a first slanted surface in mating engagement with the slanted surface of the body and a second slanted surface in mating engagement with the slanted surface of the bonnet;

a liner on the body between the body and the seal ring; and a void between the liner, the bonnet, and the seal ring, the void defining a channel extending into the body and the bonnet between the slanted surface of the body and the slanted surface of the bonnet.

2. The seal of claim 1, wherein the pressure vessel is a blowout preventer.

3. The seal of claim 1, wherein the seal is metal.

4. The seal of claim 1, further comprising a third slanted surface of the seal ring opposite the first slanted surface and a fourth slanted surface on the seal ring opposite the second slanted surface.

* * * * *